United States Patent [19]

Holkestad

[11] 4,361,233

[45] Nov. 30, 1982

[54] ANTI-THEFT PACKAGING DEVICE

[76] Inventor: Howard P. Holkestad, 3983 Hunters Hill Way, Minnetonka, Minn. 55343

[21] Appl. No.: 340,558

[22] Filed: Jan. 18, 1982

[51] Int. Cl.[3] ..... B65D 85/672

[52] U.S. Cl. ..... 206/387; 206/477; 206/601; 206/560; 220/72; 220/74; 150/52 R

[58] Field of Search ..... 206/387, 1.5, 601, 472, 206/477, 804, 560; 220/72, 74; 150/52 R

[56] References Cited

U.S. PATENT DOCUMENTS

| | | | |
|---|---|---|---|
| 3,656,612 | 4/1972 | Sellors | 206/387 |
| 3,675,763 | 7/1972 | Sandel | 206/387 |
| 4,203,519 | 5/1980 | Fujitaki | 206/387 |
| 4,245,741 | 1/1981 | Holkestad | 206/387 |
| 4,290,524 | 9/1981 | Azar | 206/387 |

*Primary Examiner*—Joseph M. Moy
*Attorney, Agent, or Firm*—Wicks & Nemer

[57] ABSTRACT

An anti-theft packaging device is disclosed, according to the teachings of the present invention as including a generally closed enclosure having an open side allowing insertion of the article to be packaged such as a recording tape. The preferred embodiment of the present invention then further includes an extension for extending the dimensions of the enclosure and thus of the particle to be packaged. The article is held against removal in the enclosure by nondestructibly, deformable dimples shown in the preferred embodiment as being disc-shaped. The preferred dimples are deformable from a first position located outside of the extension allowing the article to be passed through the extension and into the enclosure and a second position located inside of the extension for abutting with the article when it is located within the enclosure for preventing removal of the article from the enclosure. In the preferred embodiment, the anti-theft packaging device is formed by utilizing a blow molding formation process such that the wall thicknesses are very thin in comparison with prior anti-theft packaging devices and allow the inspection of the article through the walls of the anti-theft packaging device without the necessity of openings of any kind when the packaging device is formed of translucent material.

18 Claims, 4 Drawing Figures

ANTI-THEFT PACKAGING DEVICE

BACKGROUND

The present invention relates generally to packaging devices and more specifically to anti-theft packaging devices for small, easily stolen articles.

With the increasing merchandising of small, easily stolen articles, an increasing need has arisen for methods and apparatus to prevent such theft. For example, cassette tapes have become quite a popular medium for the recording of music and the spoken word in general. Cassette tapes are generally of a small dimension, one popular tape case being approximately $4\frac{3}{4}$ inches in length, $2\frac{3}{4}$ inches in width, and approximately $\frac{5}{8}$ of an inch in height. As can be easily recognized, a case of this size may be easily slipped into the pocket or purse of a thief or further concealed in packages or outer garments. Previous anti-theft packaging techniques have included a general approach of attempting to make the small article larger by excessively dimensioning the packaging in which the small article is inserted. Examples of previous anti-theft packaging techniques include those shown in U.S. Pat. Nos. 3,828,922, 3,871,516, and 4,245,741 of the present inventor. These techniques make theft more difficult.

SUMMARY

The present invention provides an improved anti-theft packaging device, which, in the preferred embodiment, generally includes an enclosure having closed first and second ends, top, bottom, and first side and an open second side. The device, in the preferred embodiment, further includes a member for extending the enclosure beyond the dimensions of the article. The article is held in the enclosure by nondestructibly deformable dimple having a first, article nonengaging position and a second article abutting position.

It is thus an object of the present invention to provide a novel anti-theft packaging device.

It is further an object of the present invention to provide a novel anti-theft packaging device consisting of only one piece.

It is further an object of the present invention to provide a novel anti-theft packaging device which can be easily, inexpensively, and rapidly fabricated.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figure 1:
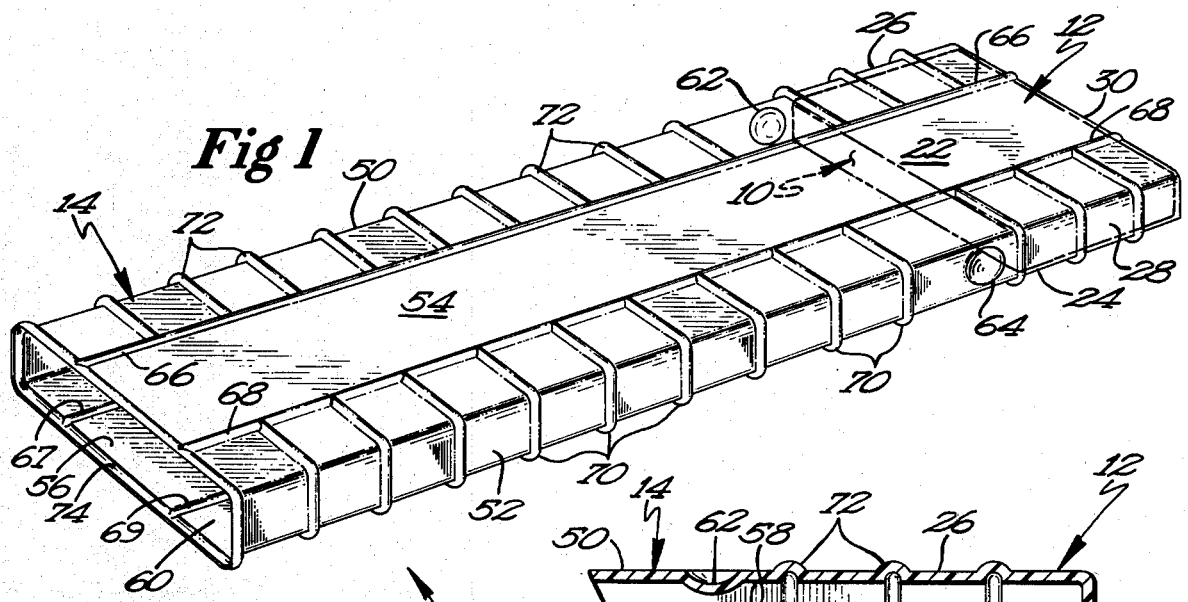
FIG. 1 shows a perspective view of an anti-theft packaging device according to the teachings of the present invention.

All figures are drawn for ease of explanation of the basic teachings of the present invention only; the extensions of the figures with respect to number, position, relationships, and dimensions of the parts to form a preferred embodiment will be explained or will be obvious once the explanation is read and understood.

Where used in the various figures of the drawings, the same numerals designate the same or similar parts in the anti-theft packaging device. Furthermore, when the terms "first", "second", "top", "bottom", "end", "side", "left", "right", and similar terms are used herein, it should be understood that these terms have reference only to the structure shown in the drawings, as it would appear to a person viewing the drawings, and are utilized only to facilitate describing the invention.

DESCRIPTION

In the figures, an anti-theft device for the packaging of small articles according to the teachings of the present invention, designated 10, is shown in the form of an enclosure, designated 12, including an extension 14 extending therefrom to extend and enlarge enclosure 12 beyond the dimensions of article 10 to be packaged. Article 10 then includes a first end edge, a second end edge, a first side edge, a second side edge, a top surface, and a bottom surface which define its dimensions.

In particular, enclosure 12 comprises a hollow parallelepiped including two parallel faces 22 and 24, two parallel ends 26 and 28 arranged perpendicular to and joining faces 22 and 24, and first and second parallel sides 30 and 32 mutually perpendicular to and joining faces 22 and 24 and ends 26 and 28. Faces 22 and 24, ends 26 and 28, and sides 30 and 32 define the dimensions of enclosure 12.

Ends 26 and 28, faces 22 and 24, and side 30 are solid in construction and thus are closed against removal of article 10 from enclosure 12 therethrough. Side 32 is open and allows for receipt of article 10 in enclosure 12.

Extension 14 is also a hollow parallelepiped and includes closed ends 50 and 52 formed by the continuation or extension of ends 26 and 28 past side 32, closed faces 54 and 56 formed by the continuation or extension of faces 22 and 24 past side 32, and first and second open sides 58 and 60. First open side 58 of extension 14 is common, equal to, or coincidental with open side 32 of enclosure 12.

Figure 2:
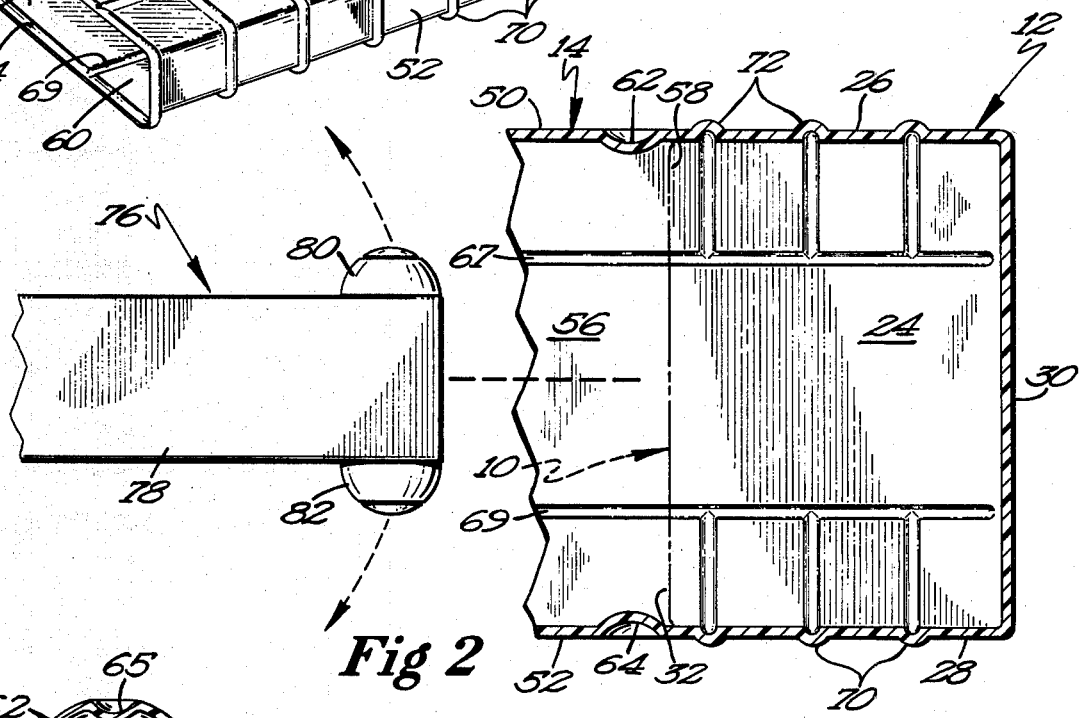
FIG. 2 shows a partial cross sectional view of the anti-theft packaging device of FIG. 1 and a partial view of a tool for use with the anti-theft packaging device of FIG. 1.
Figure 3:
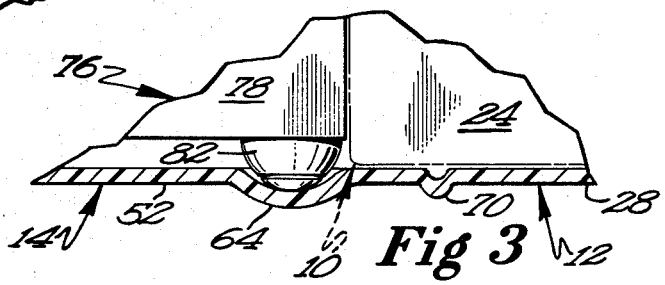
FIG. 3 shows an enlarged, partial cross sectional view of the anti-theft packaging device and tool of FIGS. 1 and 2.

Extension 14 further includes first and second nipples or dimples 62 and 64 which are nondestructibly deformable from a first position to a second position. In the first position as best seen in FIG. 3, dimples 62 and 64 are located exteriorly of extension 14, or in other words located outside of extension 14, so that no portions thereof extend beyond the inside surfaces of ends 50 and 52 or engage with article 10. In the second position as best seen in FIG. 2, dimples 62 and 64 are located interiorly of extension 10 and project beyond the inside surfaces of ends 50 and 52 and thus abut with article 10 in enclosure 12. In the preferred embodiment, dimples 62 and 64 are smooth, disc-shaped, convex, or bubble shaped and have an over center, snap-type movement. These features of the preferred embodiment have been found to enhance the deformation of dimples 62 and 64 from their first and second positions. Further, in the preferred embodiment, dimples 62 and 64 have a size complementary to and approximately equal to the size of a finger tip.

Figure 4:
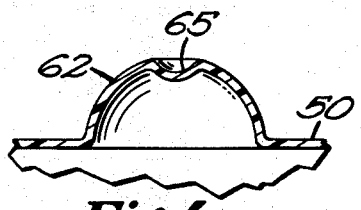
FIG. 4 shows a partial cross sectional view of the anti-theft packaging device of FIG. 1.

In the preferred form as best seen in FIG. 4, dimples 62 and 64 include starter indentations 65 formed therein.

In the preferred embodiment, indentations 65 are concave in shape and specifically are hemispherical in shape. In the preferred embodiment, the anti-theft device is manufactured with dimples 62 and 64 located in their first, exterior position. Indentations 65 then assist in moving dimples 62 and 64 to their second position for their first time by assisting the over center, snap-type movement of dimples 62 and 64. After dimples 62 and 64 are initially moved from their first position to their second position, the effect of indentations 65 on the movement of dimples 62 and 64 is negligible or nonexistent. In fact, the visual appearance of indentations 65 may disappear from dimples 62 and 64 after their first use.

To provide reinforcing for enclosure 12 and extension 14, reinforcing ribs 66, 67, 68, 69, 70, 72, and 74 are provided. Specifically, ribs 66 and 68 are formed on faces 22 and 54 of enclosure 12 and extension 14 and, in the preferred embodiment, are in a parallel, spaced relation. Likewise, ribs 67 and 69 are formed on faces 24 and 56 of enclosure 12 and extension 14 and, in the preferred embodiment, are in a parallel, spaced relation. Ribs 66 and 68 and ribs 67 and 69 are located in planes which are parallel to ends 26, 28, 50, and 52 of enclosure 12 and extension 14.

Ribs 72 extend from rib 66 over faces 22 and 54, over ends 26 and 50, and over faces 24 and 56 to rib 67. Likewise, ribs 70 extend from rib 68 over faces 22 and 54, over ends 28 and 52, and over faces 24 and 56 to rib 69. Rib 74 extends around side 60 and the exterior perimeter of faces 54 and 56 and ends 50 and 52 of extension 14.

Any suitable or desired artwork, trademarks, company identification, and like information can also be molded into the closed walls of the anti-theft packaging device according to the teachings of the present invention.

The dimensions of enclosure 12 are generally equal to but slightly larger than the dimensions of article 10 to be packaged. The dimensions of open side 60 must also allow article 10 to be passed through side 60, through the interior of extension 14, and into enclosure 12. The length of extension 14 is elongated and must be such that an appendage of the human body, such as a hand, when passed through open side 60 cannot reach dimples 62 and 64.

A preferred removal tool 76 is further provided having a handle 78 and first and second dimple depressors 80 and 82. Handle 78 has a length greater than the length of extension 14, a width less than the width of side 60 and a height substantially equal to but slightly less than the height of side 60. Depressors 80 and 82 have a shape complementary to dimples 62 and 64 and in the preferred embodiment are shown as hemispheres.

In the preferred embodiment, enclosure 12 and extension 14 are made as one piece. Thus, the anti-theft device according to the teachings of the present invention has a hollow parallelepiped shape including a top formed by faces 22 and 54 of enclosure 12 and extension 14, respectively, a bottom formed by faces 24 and 56 of enclosure 12 and enclosure 14, respectively, a first end wall formed by ends 26 and 50 of enclosure 12 and extension 14, respectively, a second end wall formed by end 28 and 52 of enclosure 12 and extension 14, respectively, a closed side wall formed by side 30 of enclosure 12, and an open side wall formed by side 60 of extension 14.

In the preferred embodiment, the anti-theft packaging device has an overall length of twelve inches, an outside height of 0.77 inches, an inside height of 0.75 inches, an outside width of 4.395 inches, and an inside width of 4.375 inches. Dimples 62 and 64 have radii of 0.310 inches and are located 3.25 inches from side 30. Indentations 65 have a radius of 0.19 inches.

In the preferred embodiment, the anti-theft packaging device according to the preferred embodiment of the present invention is made of clear or translucent material, such as plastic, and particularly in the preferred embodiment is formed of Eastman P.E.T.G. clear plastic. Furthermore, the thickness of faces 22, 24, 54, and 56, ends 26, 28, 50, and 52, and side 30 is very thin and specifically allows the inspection of and reading from article 10 therethrough, and particularly has a preferred embodiment thickness equal to 12 mils. Thus, no openings of any kind are required in the anti-theft packaging device of the present invention to allow inspection of article 10. This feature is very advantageous over prior anti-theft devices which are injection molded and require openings because of the wall thickness of these prior devices. For example, molds for forming these prior openings are more expensive to fabricate. In fact, because the anti-theft packaging device is of elongated length and has only one open side 60 while all the remaining walls of the anti-theft packaging device according to the teachings of the present invention do not have any openings and thus are completely solid, injection molding would be mechanically difficult and costly.

It should also be noted that the material from which enclosure 12 and extension 14 is made must have a sufficient flexible nature to allow the nondestructible deformation of dimples 62 and 64, and in the preferred embodiment, to be deformed several times to allow the reuse of the anti-theft packaging device of the present invention. It has been found that Eastman P.E.T.G. clear plastic meets these parameters.

In the preferred embodiment, the anti-theft packaging device according to the teachings of the present invention is especially adapted for fabrication by a blow molding technique rather than injection molding techniques as used in prior anti-theft packaging devices, including the prior devices of the present inventor. One major reason that the present invention is adaptable for blow molding fabrication is that the device consists of five solid sides which do not have any openings of any kind. Blow molding has several advantages over injection molding. First, blow molding requires less maintenance and thus is considered 2 times faster than injection molding. The blow molds are considered approximately 3 times less expensive to build than injection molds. The life of a blow mold is considered to be approximately 5 times longer than injection molds and in fact may be infinitely longer than injection molds. Further, the cycle time of blow molding is much shorter than the cycle time for injection molding so that blow molds can run about 50% more cycles than injection molding. Thus, the cost of production including both tooling and labor is considerably less for blow molding than for injection molding and thus anti-theft packaging devices according to the teachings of the present invention can be relatively inexpensively produced.

Now that the structure of the anti-theft packaging device according to the teachings of the present invention has been set forth, the operation, advantages, and subtle features of the present invention can be explained and appreciated. For purposes of this explanation, it is assumed that article 10 is located outside of the anti-theft device and that dimples 62 and 64 are located in their first position exteriorly of extension 14 as best seen in FIGS. 3 and 4. To package article 10 in the anti-theft packaging device, the first side edge of article 10 is inserted into extension 14 through open side 60. The anti-theft packaging device is then tilted such that article 10 can slide through the interior of extension 14, through open side 58 of extension 14 and side 32 of enclosure 12 into the interior of enclosure 12. At that time, fingers of the user may then be placed upon dimples 62 and 64. When pressure is applied by the fingers of the user, dimples 62 and 64 nondestructibly deform into its second position as best seen in FIG. 2. It should then be noted that in the preferred embodiment, dimples 62 and 64 snap in an over-center manner from its first position as seen in FIGS. 3 and 4 to its second position as best seen in FIG. 2. It should then be further noted that indentations 65 assist the initial movement of dimples 62 and 64 of the preferred embodiment of the present invention from their first position to their second position after their manufacture.

As best seen in FIG. 2, article 10 is then captured within the interior of enclosure 12 since the second side edge of article 10 will abut with dimples 62 and 64 in their second position. Thus, dimples 62 and 64 block or present obstructions to the sliding of article 10 from enclosure 12 into and through extension 14. Thus, article 10 cannot be removed from enclosure 12 when dimples 62 and 64 are located in their second position, but can only be removed when dimples 62 and 64 are deformed into their first position.

It can then be appreciated that dimples 62 and 64 cannot be moved from their second position, as best seen in FIG. 2, to their first position, as best seen in FIG. 3, from the outside, but it is necessary to apply pressure to dimples 62 and 64 on their inside surfaces interiorly of extension 14. Due to the elongated length of extension 14 and its relationship with opening 60 of extension 14, a human appendage, such as a hand, cannot be extended into extension 14 such that the fingers can reach and be placed upon dimples 62 and 64. Thus, article 10 cannot be removed from the interior of enclosure 12 without the use of a dimple depressing tool.

It can then be appreciated that the anti-theft packaging device of the preferred embodiment can then be sold with article 10 so that no assistance is required of store personnel. Furthermore, due to the very low expense of the anti-theft packaging device according to the teachings of the present invention in comparison to the expense of prior anti-theft packaging devices, the present anti-theft packaging device is particularly adaptable for sale with article 10. It can then be appreciated that the consumer can remove article 10 from the anti-theft packaging device of the present invention after its purchase by destroying the anti-theft packaging device such as by cutting.

However, tool 76 of the present invention allows the reuse of the anti-theft packaging device of the present invention. Specifically, tool 76 can be inserted into open side 60 of extension 14 until depressors 80 and 82 are located adjacent to dimples 62 and 64. Thus, by manipulation of the portion of handle 78 located outside of extension 14, dimples 62 and 64 can be nondestructibly deformed from their second position, as best seen in FIG. 2, to their first position, as best seen in FIG. 3. It can then be appreciated due to the particular construction and size of tool 76 in relation to extension 14 and especially since the width of handle 78 is substantially less than the width of side 60 and also since dimples 62 and 64 are formed in ends 50 and 52, that tool 76 can be positioned such that depressor 80 engages with and deforms dimple 62 and then without removing tool 76, tool 76 can be swung in an arc such that depressor 82 engages with and deforms dimple 64. Furthermore, no alignment of tool 76 is required since tool 76 can be inserted until the end of tool 76 engages article 10 located within enclosure 12 and tool 76 is simply swung or moved back and forth within the interior of extension 14. After dimples 62 and 64 are in their first position as shown in FIG. 3 and tool 76 removed, the anti-theft packaging device can be tilted such that article 10 slides from enclosure 12, through extension 14, and out of opening 60. The anti-theft packaging device is then ready to receive another article 10.

It should then be noted that after dimples 62 and 64 have been deformed from their first position into their second position a number of times, some stretching of the material of dimples 62 and 64 may occur. Although this stretching of the material may detract from the appearance of the anti-theft packaging device of the present invention and dimples 62 and 64 loose some or all of their snap-type movement, dimples 62 and 64 can still be deformed from their first position to their second position and such stretching will not affect the operability of the present invention.

Now that the basic teachings of the present invention have been explained, many extensions and variations will be obvious to one having ordinary skill in the art. For example, although the anti-theft packaging device has been explained and is especially adaptable for use with a cassette recording tape box, the anti-theft packaging device can be utilized with other small, easily stolen articles such as 8-track tape cartridges and many other articles.

Furthermore, the particular orientation of article 10 shown in the drawings is preferred, but the dimensions of enclosure 12 and extension 14 can be varied to allow article 10 to be placed in other orientations.

Likewise, although in the preferred embodiment two dimples 62 and 64 are shown and have been found to be particularly advantageous, as explained hereinbefore and hereinafter, fewer or more dimples of the same, similar, or different configurations and at the same or different positions can be provided. For example, a wedge-shaped dimple could be provided in bottom 56 of extension 14 in addition to dimples 62 and 64. Such a wedge-shaped dimple could be positioned to present an angle incline to article 10 and an abutting edge to abut with article 10 when it is located in enclosure 12.

Additionally, although tool 76 of the present invention is preferred, other constructions of tools for depressing dimples 62 and 64 will be obvious to persons skilled in the art after the teachings of the present invention become known. For example, a rod bent into a generally L-shape having an extension extending at an angle from the first leg including a rubber tip of a size complementary to the size of dimples 62 and 64 and a handle attached to the second leg can be utilized. In operation, the rubber tip can be placed on one of the dimples 62 and 64 and the apex of the first and second legs of the L-shaped member placed on the inside surface of the opposite end 50 and 52 of extension 14. Thus, the tool can be pivoted about the apex to move the dimple from its second position inside extension 14 to its first position outside extension 14. A spacer for holding the rubber tip adjacent the center of the dimples can also be provided. For example, a block placed on the first leg of the L-shaped member having a height equal to the height of extension 14 can be utilized for this purpose.

Thus, since the invention disclosed herein may be embodied in other specific forms without departing from the spirit or general characteristics thereof, some of which forms have been indicated, the embodiments described herein are to be considered in all respects illustrative and nonrestrictive. The scope of the invention is indicated by the appended claims rather than by the foregoing description, and all changes which come within the meaning and range of equivalency of the claims are intended to be embraced therein.

What is claimed is:

1. Anti-theft device for packaging an article such as a recording tape having a first end edge, a second end edge, a first side edge, a second side edge, a top surface, and a bottom surface defining its dimensions, comprising, in combination: means for enclosing the article including a first closed side, a second open side, a first closed end, a second closed end, a closed bottom, and a closed top defining the dimensions of the enclosing means, with the dimensions of the article being approximately equal to but slightly smaller than the dimensions of the enclosing means; means attached to the enclosing means for extending the enclosing means to enlarge the enclosing means beyond the dimensions of the article for preventing easy concealment of the anti-theft packaging device by a perspective thief, with the extending means having an elongated length and including a first closed end formed by the continuation of the first end of the enclosing means past the second side of the enclosing means, a second closed end formed by the continuation of the second end of the enclosing means past the second side of the enclosing means, a closed bottom formed by the continuation of the bottom of the enclosing means past the second side of the enclosing means, a closed top formed by the continuation of the top of the enclosing means past the second side of the enclosing means, a first open side, and a second open side, with the first open side of the extending means being coincidental with the second open side of the enclosing means; means for retaining the article in the enclosing means comprising, in combination: at least one dimple located in the extending means adjacent the second side of the enclosing means and nondestructibly deformable between a first position located outside of the extending means and a second position located inside of the extending means and abutting with the article located in the enclosing means for preventing removal of the article from the enclosing means, with the length of the extending means and the size of the second open side of the extending means having a relationship to prevent the engagement of the dimple inside of the extending means by a human appendage such as a finger.

2. The anti-theft device of claim 1 wherein the first side, the first and second ends, top, and bottom of the enclosing means and the first and second ends, top, and bottom of the extending means are formed of translucent material and have a thickness allowing inspection of the recording tape therethrough without the necessity of openings of any kind.

3. The anti-theft device of claim 2 further comprising reinforcing ribs formed in at least one of the enclosing means and extending means.

4. The anti-theft device of claim 3 wherein the reinforcing ribs comprise, in combination: first and second parallel-spaced ribs formed on the top of the enclosing means and the extending means; third and fourth parallel-spaced ribs formed on the bottom of the enclosing means and the extending means; a plurality of parallel spaced fifth ribs extending from the first rib to the third rib over the top of the extending means and the enclosing means, over the first end of the enclosing means and the extending means, and over the bottom of the extending and enclosing means; and a plurality of parallel-spaced sixth ribs extending between the second and fourth ribs over the top of the extending means and the enclosing means, over the second end of the extending means and the enclosing means, and over the bottom of the extending means and the enclosing means.

5. The anti-theft device of claim 2 wherein the anti-theft device is formed utilizing a blow molding formation process.

6. The anti-theft device of claim 1 wherein the anti-theft device is formed utilizing a blow molding formation process.

7. The anti-theft device of claim 6 wherein the anti-theft device is formed of plastic.

8. The anti-theft device of claim 1 or 7 wherein the anti-theft device is formed of flexible plastic.

9. The anti-theft device of claim 1 wherein the dimple has an over center snap type movement.

10. The anti-theft device of claim 9 wherein the dimple is disc-shaped.

11. The anti-theft device of claim 10 wherein the dimple is smooth to enhance its ability to snap from its first position to its second position.

12. The anti-theft device of claim 9 wherein the anti-theft device is formed of flexible plastic to enhance its ability to snap from its first position to its second position.

13. The anti-theft device of claim 1 further comprising an article removal tool insertable into the extending means through the second side of the extending means including an elongated handle having a length greater than the length of the extending means and means located adjacent an end of the handle for deforming the dimple of the extending means.

14. The anti-theft device of claim 13 wherein the anti-theft device includes a first and a second convex dimples, with the dimples formed in the ends of the extending means.

15. The anti-theft device of claim 14 wherein the article removal tool includes first and second deforming means and wherein the first and second dimples can be deformed by a swinging movement of the article removal tool and without requiring removal of the article removal tool from the extending means.

16. The anti-theft device of claim 13 wherein the deforming means is a depressor having a shape complementary to the dimple of the extending means.

17. The anti-theft device of claim 16 wherein the depressor has a hemispherical shape.

18. The anti-theft device of claim 1 or 12 wherein the dimple includes a starter indentation formed therein for assisting movement of the dimple from its first, exterior position to its second, interior position for the first movement time.

* * * * *